US010493603B2

(12) United States Patent
Dekam

(10) Patent No.: US 10,493,603 B2
(45) Date of Patent: Dec. 3, 2019

(54) FASTENER REMOVAL APPARATUS

(71) Applicant: Robert Lambertus Dekam, Langley (CA)

(72) Inventor: Robert Lambertus Dekam, Langley (CA)

( * ) Notice: Subject to any disclaimer, the term of this patent is extended or adjusted under 35 U.S.C. 154(b) by 642 days.

(21) Appl. No.: 15/185,391

(22) Filed: Jun. 17, 2016

(65) Prior Publication Data

US 2017/0361431 A1 Dec. 21, 2017

(51) Int. Cl.

| | |
|---|---|
| ***B25B 13/48*** | (2006.01) |
| ***B25B 13/10*** | (2006.01) |
| ***B25B 17/00*** | (2006.01) |
| ***B25B 21/00*** | (2006.01) |

(52) U.S. Cl.

CPC ..... *B25B 13/488* (2013.01); *B25B 13/102* (2013.01); *B25B 17/00* (2013.01); *B25B 21/002* (2013.01)

(58) Field of Classification Search

CPC ..... B25B 13/488; B25B 13/102; B25B 17/00; B25B 21/002; B25B 21/001; B25B 13/48; B25B 13/463; B25B 13/10; B25B 21/00; B25B 13/465; B25B 23/0007; B25B 23/0035; B25B 15/04; B25B 13/466

See application file for complete search history.

(56) References Cited

U.S. PATENT DOCUMENTS

| | | | | |
|---|---|---|---|---|
| 1,343,667 A | | 6/1920 | Evensen | |
| 2,479,225 A | | 8/1949 | Gann | |
| 2,630,731 A | | 3/1953 | Imboden | |
| 2,909,089 A | | 10/1959 | Thompson et al. | |
| 3,247,741 A | * | 4/1966 | Batten | B25B 21/002 81/56 |
| 3,392,608 A | | 7/1968 | Schanen et al. | |

(Continued)

FOREIGN PATENT DOCUMENTS

| | | |
|---|---|---|
| CA | 2291185 A1 | 12/1998 |
| CN | 203185281 U | 9/2013 |

(Continued)

OTHER PUBLICATIONS

International Search Report and Written Opinion, dated Aug. 18, 2017, for corresponding International Application No. PCT/IB2017/052983.

*Primary Examiner* — Robert J Scruggs

(74) *Attorney, Agent, or Firm* — Black, McCuskey, Souers & Arbaugh LPA

(57) ABSTRACT

A fastener removal apparatus is configured for removing a nut from a threaded shank and includes a gearbox assembly, an outer socket, and a tubular sleeve member. The gearbox assembly has an input member, a first output member, a second output member, and a plurality of gears. The first output member and the second output member rotation in opposite directions about a longitudinal axis in response to rotation imparted to the input member. The outer socket extends between a first end defining a female polygonal opening and a second end engaged for concurrent rotation with the first output member. The tubular sleeve member extends between a first end defining a threaded opening for receiving threads defined by the threaded shank and a second end engaged for concurrent rotation with the second output member.

22 Claims, 11 Drawing Sheets

(56) References Cited

U.S. PATENT DOCUMENTS

| | | | | |
|---|---|---|---|---|
| 3,733,937 | A | 5/1973 | Mezey | |
| 3,972,252 | A | 8/1976 | Hunter | |
| 4,289,049 | A | 9/1981 | Rebish | |
| 4,462,281 | A | 7/1984 | Zils | |
| 5,018,410 | A | 5/1991 | Farnsworth | |
| 5,108,238 | A | 4/1992 | Ewing | |
| 5,125,297 | A | 6/1992 | Bai et al. | |
| 5,129,290 | A | 7/1992 | Haviv | |
| 5,238,461 | A * | 8/1993 | Gotman | B25B 13/488 475/248 |
| 5,499,554 | A | 3/1996 | Ilyes | |
| 5,582,079 | A * | 12/1996 | Matsumura | B25B 21/002 81/56 |
| 5,722,808 | A | 3/1998 | Pritchard | |
| 5,953,965 | A | 9/1999 | Kaneyama et al. | |
| 6,000,299 | A | 12/1999 | Cole | |
| 6,739,221 | B2 | 5/2004 | Cha | |
| 2007/0251359 | A1* | 11/2007 | Junkers | B25B 13/488 81/464 |
| 2009/0084567 | A1 | 4/2009 | Basham et al. | |
| 2016/0067849 | A1 | 3/2016 | Junkers et al. | |
| 2017/0095915 | A1* | 4/2017 | Jaeger | B25B 13/06 |

FOREIGN PATENT DOCUMENTS

| | | | |
|---|---|---|---|
| EP | 0556536 | A1 | 8/1993 |
| FR | 1530346 | A | 7/1967 |

* cited by examiner

FASTENER REMOVAL APPARATUS

BACKGROUND

1. Field

The present disclosure relates to a fastener removal apparatus for removing fasteners that require a high level of force to remove.

2. Description of Related Prior Art

U.S. Pat. No. 2,479,225 discloses a GEAR OPERATED DUAL WRENCH. This invention relates to wrenches and more particularly to a wrench adapted to facilitate the application and removal of outer nuts to or from sleeve nuts, that is, to provide torque in two directions simultaneously to two co-axial nuts and alternatively, by the use of a part of a wrench, to apply torque directly to one of said nuts.

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

A fastener removal apparatus is configured for removing a nut from a threaded shank. The fastener removal apparatus includes a gearbox assembly, an outer socket, and a tubular sleeve member. The gearbox assembly has an input member, a first output member, a second output member, and a plurality of gears disposed between the input member and the first output member such that the first output member and the second output member rotation in opposite directions about a longitudinal axis in response to rotation imparted to the input member. The outer socket extends along and is centered on the longitudinal axis between a first end defining a female polygonal opening for mating with the fastening nut and a second end spaced from the first end along the longitudinal axis and engaged for concurrent rotation with the first output member. The tubular sleeve member is surrounded by the outer socket. The tubular sleeve member extends along and is centered on the longitudinal axis between a first end defining a threaded opening for receiving threads defined by the threaded shank and a second end spaced from the first end along the longitudinal axis and engaged for concurrent rotation with the second output member.

BRIEF DESCRIPTION OF THE DRAWINGS

The detailed description set forth below references the following drawings.

DETAILED DESCRIPTION

Figure 1:
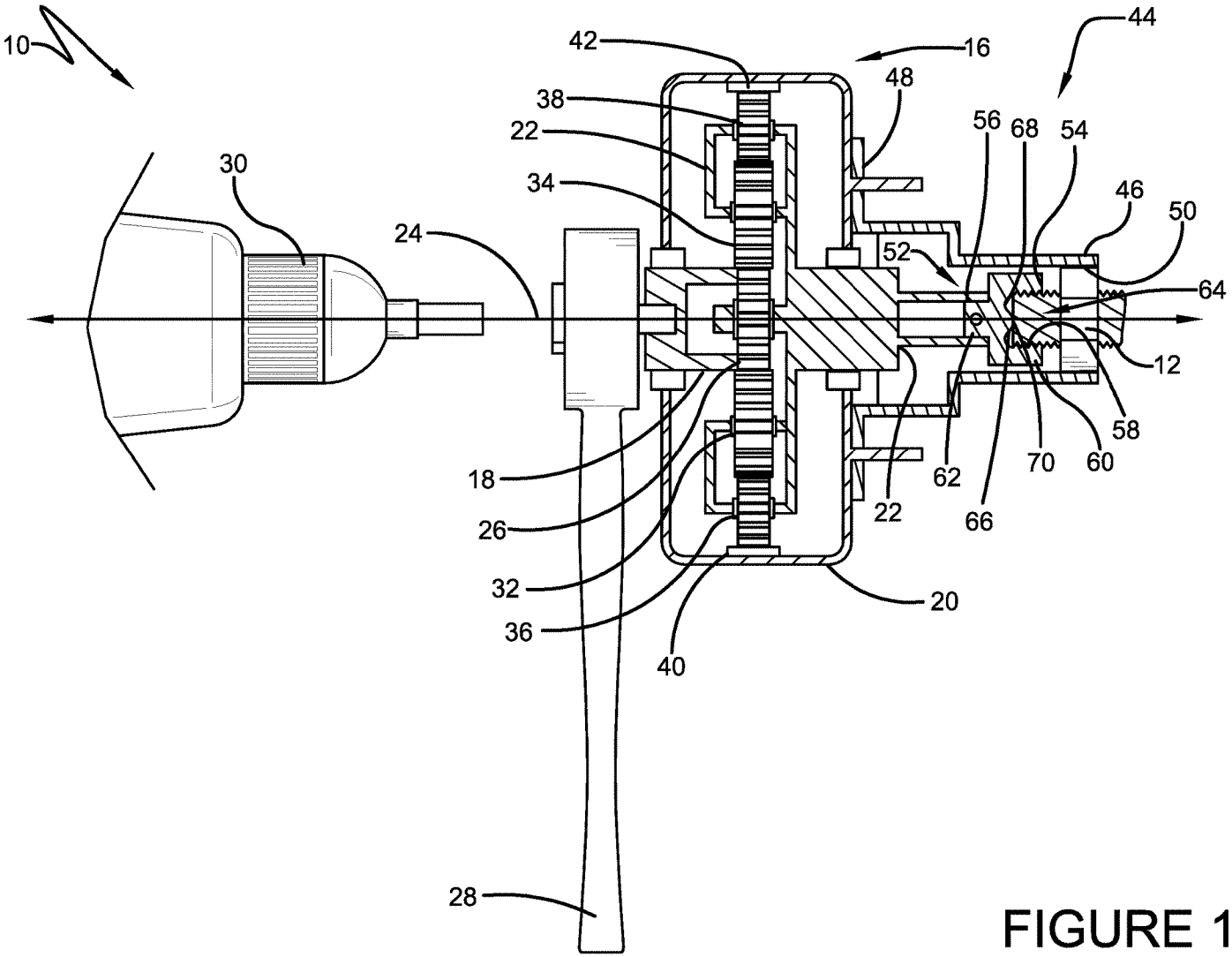
FIG. 1 is a cross-section of a fastener removal apparatus according to an exemplary embodiment of the present disclosure.

A plurality of different embodiments of the present disclosure is shown in the Figures of the application. Similar features are shown in the various embodiments of the present disclosure. Similar features across different embodiments have been numbered with a common reference numeral and have been differentiated by an alphabetic suffix. Similar features in a particular embodiment have been numbered with a common two-digit, base reference numeral and have been differentiated by a different leading numeral. Also, to enhance consistency, the structures in any particular drawing share the same alphabetic suffix even if a particular feature is shown in less than all embodiments. Similar features are structured similarly, operate similarly, and/or have the same function unless otherwise indicated by the drawings or this specification. Furthermore, particular features of one embodiment can replace corresponding features in another embodiment or can supplement other embodiments unless otherwise indicated by the drawings or this specification.

The present disclosure, as demonstrated by the exemplary embodiment described below, can provide a fastener removal apparatus for removing fasteners that require a high level of force to remove. The fastener removal apparatus obviates the need for a reaction arm. The fastener removal apparatus can impart load on a bolt while the nut fastened to the bolt is loosened. Thus, the fastener removal apparatus embodies the method of imparting reaction force on the subject bolt (the bolt encircled by the fastener to be removed) rather than on some other structure and rather than through a reaction arm, also allowing an adjustable flex joint to be used, which cannot be through a reaction arm.

Referring now to FIG. 1, a fastener removal apparatus 10 is configured for removing a nut 12 from a threaded shank 14. The fastener removal apparatus 10 includes a gearbox assembly 16. The gearbox assembly 16 has an input member 18, a first output member 20, a second output member 22, and a plurality of gears disposed between the input member 18 and the first output member 20 such that the first output member 20 and the second output member 22 rotation in opposite directions about a longitudinal axis 24 in response to rotation imparted to the input member 18.

The plurality of gears can include a sun gear 26 fixed for rotation with the input member 18. The sun gear 26 can be rotated by a wrench 28 or by a drill 30. The plurality of gears can include intermediate planetary gears, such as gears 32, 34. The gears 32, 34 can be meshed with the sun gear 26. The gears 32, 34 can be supported on the second output member 22. The second output member 22 can act as a gear carrier. The plurality of gears can include outer planetary gears, such as gears 36, 38. The gears 36, 38 can be meshed with the intermediate planetary gears 32, 34. The gears 36, 38 can also be supported on the second output member 22. The first output member 20 can include inwardly-directed gear teeth, such as teeth 40, 42. The teeth 40, 42 can be meshed with the outer planetary gears 36, 38. In an exemplary operation, rotation in a first rotational direction that is imparted to the input member 18 is transmitted through the plurality of gears and results in rotation of the first output member 20 in the first rotational direction and rotation of the second output member 22 in a second rotational direction that is opposite to the first rotational direction.

The fastener removal apparatus 10 includes an outer socket 44. The outer socket 44 extends along and is centered on the longitudinal axis 24 between a first end 46 and a second end 48. The first end 46 can define a female polygonal opening 50 for mating with the fastening nut 12. A polygon is a plane figure (two dimensional) with at least three straight sides. A polygonal opening is an opening that includes at least three straight sides. The female polygonal opening 50 mates with the fastening nut 12 in that the female polygonal opening 50 receives the fastening nut 12 and the two components will rotate together. The second end 48 can be spaced from the first end 46 along the longitudinal axis 24 and engaged for concurrent rotation with the first output member 20.

The fastener removal apparatus 10 includes a tubular sleeve member 52. The tubular sleeve member 52 is surrounded by the outer socket 44. The tubular sleeve member 52 extends along and is centered on the longitudinal axis 24 between a first end 54 defining a threaded opening 58 for receiving threads defined by the threaded shank 14 and a second end 56 spaced from the first end 54 along the longitudinal axis 24 and engaged for concurrent rotation with the second output member 22.

The exemplary tubular sleeve member 52 includes tubular sleeve portion 60 and a driver portion 62. The tubular sleeve portion 60 can include the first end 54 and the threaded opening 58. The driver portion 62 can include the second end 56 of the tubular sleeve member 52 and can be engaged for concurrent rotation with the second output member 22.

In the first exemplary embodiment of the present disclosure, the tubular sleeve portion 60 and the driver portion 62 are integrally-formed with respect to one another. "Integrally-formed" refers to the fact that in the exemplary embodiment the the tubular sleeve portion 60 and the driver portion 62 are formed together rather than being formed separately and then subsequently joined. The term defines a structural feature since structures that are integrally-formed are structurally different than structures that are comprised of subcomponents formed separately and then subsequently joined. "Integral" means consisting or composed of parts that together constitute a whole and thus encompasses structures of more than one part wherein the parts are either integrally-formed or formed separately and then subsequently joined.

The tubular sleeve member 52 also includes a blind aperture 64 and a protuberance 66. The blind aperture 64 can be defined by the tubular sleeve portion 60 in cooperation with the driver portion 62. The blind aperture 64 can be centered on the longitudinal axis 24 and open toward the first end 54. The blind aperture 64 can have a floor 68. The protuberance 66 can project along the longitudinal axis 24 away from the floor 68 toward the threaded opening 58. The protuberance 66 can have a tip 70 spaced from the floor 68. The tip 70 can have a diameter smaller than a diameter of the blind aperture 64.

In an exemplary method of using the first embodiment, the exemplary tubular sleeve member 52 can be screwed onto the shank 14, the threads of the tubular sleeve portion 60, disposed in the blind aperture 64, threaded on the threads of the shank 14. The tubular sleeve member 52 can be screwed onto the shank 14 until the tip 70 contacts the distal end of the shank 14. The second output member 22 can then mate with the driver portion 62 and, concurrently, the female polygonal opening 50 of the first output member 20 can mate with the nut 12. Rotation can then be input to the input member 18, resulting in the breaking of the engagement between the threads of the nut 12 and the threads of the shank 14. After the engagement between the threads of the nut 12 and the threads of the shank 14 is broken, the fastener removal apparatus 10 can be removed and the nut 12 can be removed with a wrench or by hand. A wrench can also be used to remove the tubular sleeve member 52 from the shank 14.

Figure 2:
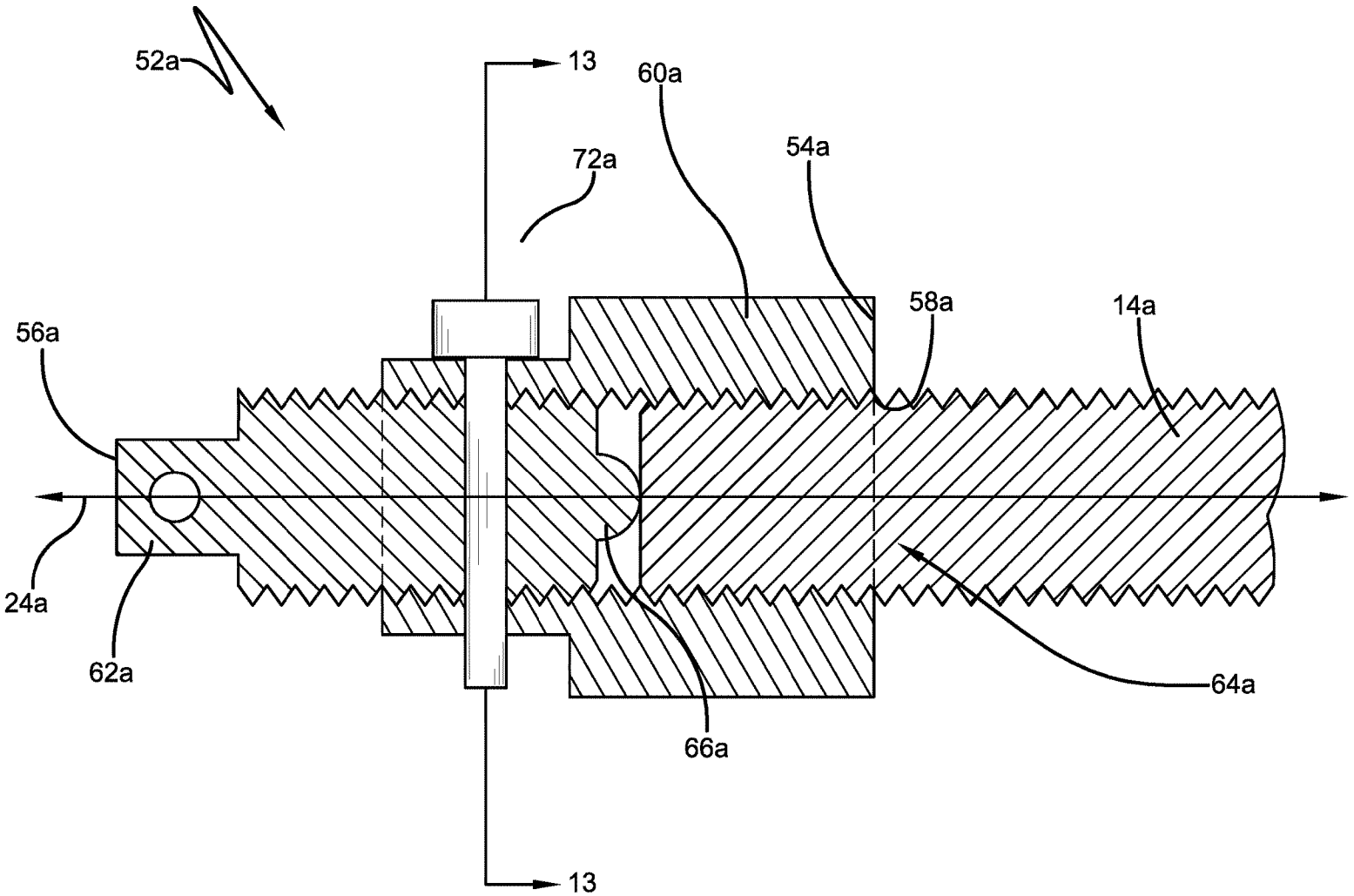
FIG. 2 is a cross-section of a tubular sleeve member of a fastener removal apparatus according to another exemplary embodiment of the present disclosure.

FIG. 2 is a cross-section of a tubular sleeve member **52*a* of a fastener removal apparatus according to another exemplary embodiment of the present disclosure. The tubular sleeve member 52*a* extends along and is centered on a longitudinal axis 24*a* between a first end 54*a* defining a threaded opening 58*a* for receiving threads defined by a threaded shank 14*a* and a second end 56*a* spaced from the first end 54*a* along the longitudinal axis 24*a* and engageable for concurrent rotation with a second output member such as the second output member 22**.

The exemplary tubular sleeve member **52*a* includes tubular sleeve portion 60*a* and a driver portion 62*a*. The tubular sleeve portion 60*a* can include the first end 54*a* and the threaded opening 58*a*. The driver portion 62*a* can include the second end 56*a*. In the second exemplary embodiment of the present disclosure, the tubular sleeve portion 60*a* and the driver portion 62*a* are threadingly-engaged with respect to one another. The tubular sleeve member 52*a* also includes a blind aperture 64*a* and a protuberance 66*a*, similar to the blind aperture 64 and protuberance 66 of the first embodiment. The exemplary tubular sleeve member 52*a* can also include a pin 72*a* extending perpendicular to the longitudinal axis 24*a*. The pin 72*a* can pass through at least part of the tubular sleeve portion 60*a* and at least part of the driver portion 62*a***.

In an exemplary method of using the second embodiment, the exemplary tubular sleeve member **52*a* can be screwed onto the shank 14*a*, the threads of the tubular sleeve portion 60*a*, disposed in the blind aperture 64*a*, threaded on the threads of the shank 14*a*. The tubular sleeve member 52*a* can be screwed onto the shank 14*a* until the tip of the protuberance 66*a* contacts the distal end of the shank 14*a*. A second output member can then mate with the driver portion 62*a* and, concurrently, a female polygonal opening of a first output member can mate with a nut on the shank 14*a*. Rotation can then be input to an input member, resulting in the breaking of the engagement between the threads of the nut and the threads of the shank 14*a*. After the engagement between the threads of the nut and the threads of the shank 14***a* is broken, the fastener removal apparatus can be removed and the nut can be removed with a wrench or by hand. A wrench can also be used to remove the tubular sleeve member 52*a* from the shank 14*a*.

The second exemplary embodiment can include structure to accommodate or permit lost motion between the tubular sleeve portion 60*a* and a driver portion 62*a* over less than three hundred and sixty degrees. After input rotation, such as in the first rotational direction, is applied to break the engagement between the threads of the nut and the threads of the shank 14*a*, the driver portion 62*a* can be rotated in a second rotational direction opposite to the first rotational direction, relative to the tubular sleeve portion 60*a* this can allow the protuberance 66*a* to be backed-off from the shank 14*a*, thereby reducing the compressive loading generated during the breaking of the engagement between the threads of the nut and the threads of the shank 14*a*. This can reduce the force required to break the engagement between the threads of the tubular sleeve portion 60*a* and the threads of the shank 14*a*.

Figure 13:
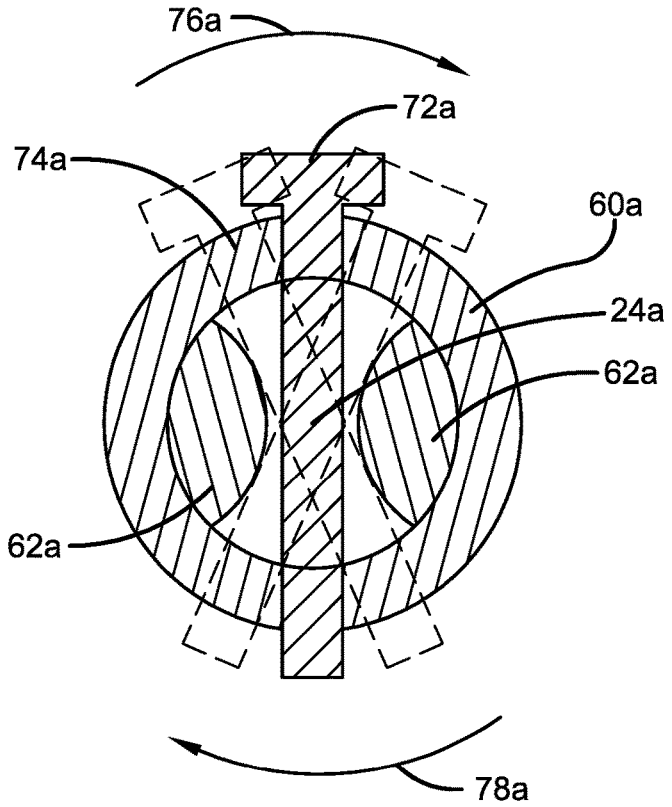
FIG. 13 is a cross-sectional view take through section lines 13-13 in FIG. 2.

In the second exemplary embodiment, lost motion can be achieved in at least two different ways. In a first approach, the pin 72*a* can be received in a slot 74*a* in the driver portion 62*a* that extends around the longitudinal axis 24*a*. This is shown in FIG. 13. Arrows indicate the extension of the slot 74*a* about the longitudinal axis 24*a*. During concurrent rotation of the tubular sleeve portion 60*a* and the driver portion 62*a* in the first rotational direction as the engagement between the threads of the nut and the threads of the shank 14*a* is broken, the pin 72*a* can be in the position (relative to the slot 74*a*) shown in phantom clockwise of the pin 72*a* shown in solid line. During relative rotation of the driver portion 62*a* relative to the tubular sleeve portion 60*a* in the second rotational direction 78*a* as the protuberance 66*a* is drawn back from the shank 14*a*, the pin 72*a* can be in the position (relative to the slot 74*a*) shown in phantom counter-clockwise of the pin 72*a* is solid line.

Figure 14:
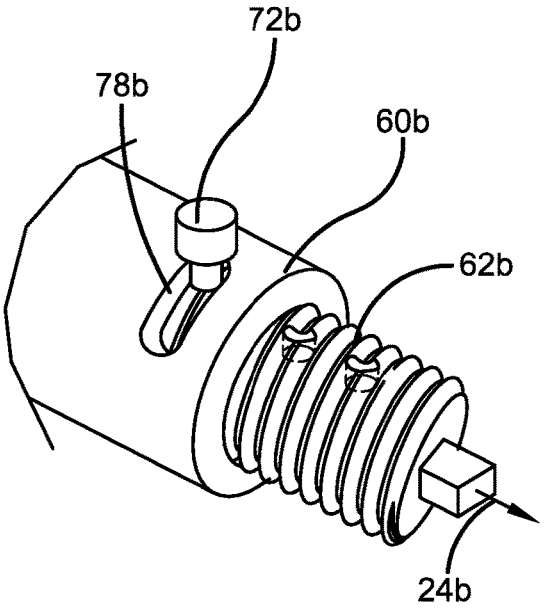
FIG. 14 is a perspective view of a portion of the tubular sleeve assembly according to another exemplary embodiment of the present disclosure.

In a second approach, a pin 72*b* can be received in a slot 78*b* in the tubular sleeve portion 60*b* that extends around the longitudinal axis 24*b*. This is shown as another exemplary embodiment of the present disclosure in FIG. 14. A slot mirroring slot 78*b* can be defined on the underside of the tubular sleeve portion 60*b* that is not visible in FIG. 14. Also, multiple slots could be formed in tubular sleeve portion 60*b*, spaced along the axis 24*b* to accommodate different operating environments. Such an embodiment could have spring loaded shaft keys/pins. In the first approach, the pin 72*a* can be fixed with tubular sleeve portion 60*a* for rotation. In the second approach, the pin 72*b* can be fixed with driver portion 62*b* for rotation.

The tubular sleeve portion 60*a* and the driver portion 62*a* are thus threadingly-engaged with respect to one another such that in response to rotation of the driver portion 62 in the first rotational direction over at least some angular range, the tubular sleeve portion 60 is driven in the first rotational direction. The angular range can be greater or less than three hundred and sixty degrees. Also, the tubular sleeve portion 60*a* and the driver portion 62*a* are threadingly-engaged with respect to one another such that in response to rotation of the driver portion 62*a* in the second rotational direction opposite to the first rotational direction over the angular range, the tubular sleeve portion 60*a* is not driven in the second rotational direction. The extent of relative rotation permitted can vary as desired. For example, the various approaches shown in FIGS. 13 and 14 can permit an angular range as a one-quarter or less turn of the driver portion and the tubular sleeve portion relative to one another.

Figure 3:
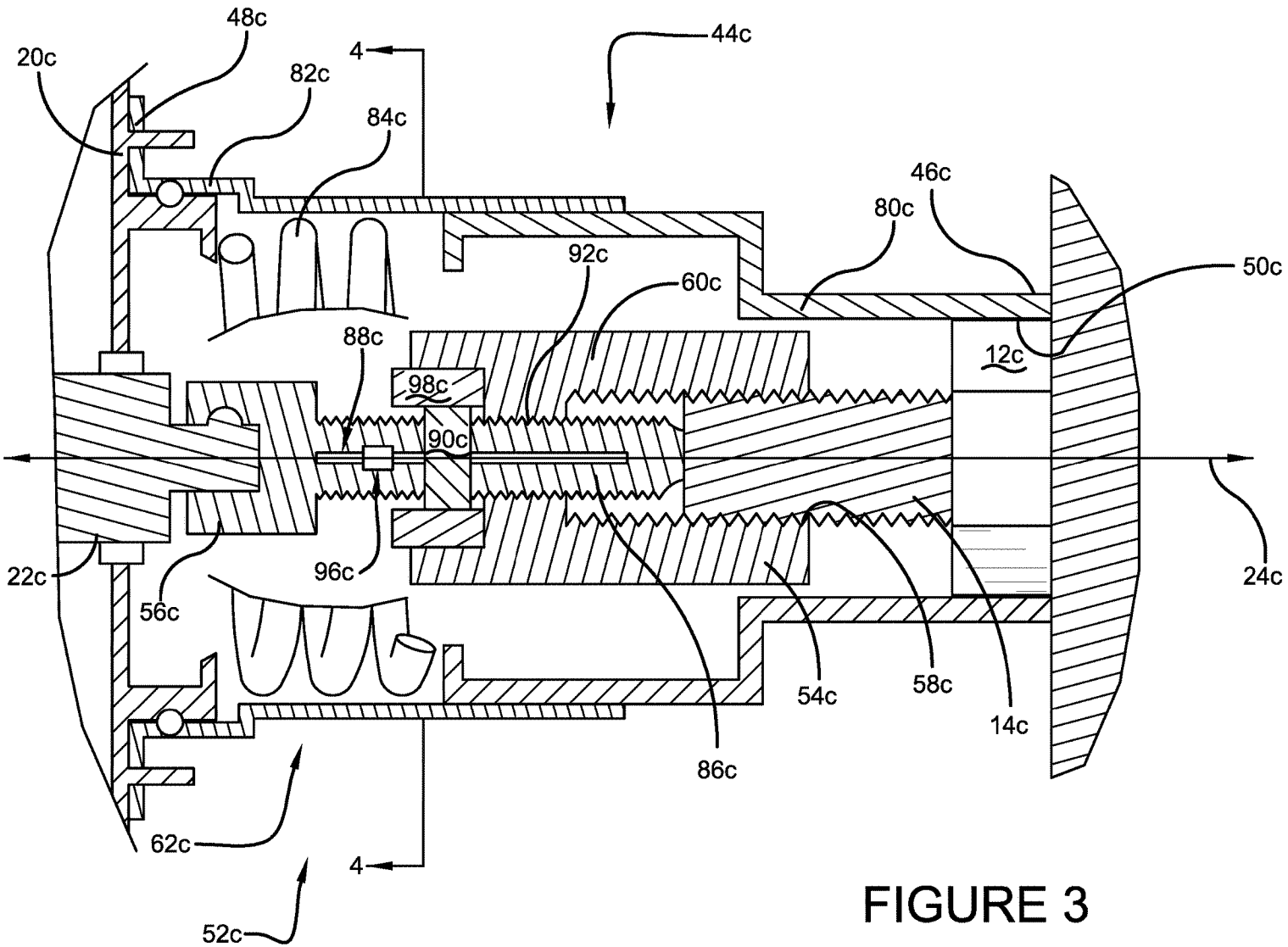
FIG. 3 is a cross-section of a tubular sleeve member and an outer socket of a fastener removal apparatus according to another exemplary embodiment of the present disclosure.

FIG. 3 is a cross-section of a tubular sleeve member 52*c* and an outer socket 44*c* of a fastener removal apparatus according to another exemplary embodiment of the present disclosure. The outer socket 44*c* can include a first socket portion 80*c* and a second socket portion 82*c*. The first socket portion 80*c* can include the first end 46*c* of the outer socket 44*c* and the female polygonal opening 50*c*. The second socket portion 82*c* can include the second end 48*c* of the outer socket 44*c* and can be engaged for concurrent rotation with a first output member 20*c*. The first socket portion 80*c* and the second socket portion 82*c* can be telescopically engaged with one another. A spring 84*c* can bias the first socket portion 80*c* away from the second socket portion 82*c* and away from the first output member 20*c* to maximize the length of the outer socket 44*c* along the longitudinal axis 24*c*. The outer socket 44*c* can be telescopically retracted by urging the first socket portion 80*c* into the second socket portion 82*c*, against the biasing force exerted by the spring 84*c*. One or more embodiments of the present disclosure can include one or more clips to retain the outer socket 44*c* in the telescopically retracted condition.

The tubular sleeve member 52*c* extends along and is centered on a longitudinal axis 24*c* between a first end 54*c* defining a threaded opening 58*c* for receiving threads defined by a threaded shank 14*c* and a second end 56*c* spaced from the first end 54*c* along the longitudinal axis 24*c* and engageable for concurrent rotation with a second output member 22*c*.

The exemplary tubular sleeve member 52*c* includes tubular sleeve portion 60*c* and a driver portion 62*c*. The tubular sleeve portion 60*c* can include the first end 54*c* and the threaded opening 58*c*. The driver portion 62*c* can include the second end 56*c*. In the third exemplary embodiment of the present disclosure, the tubular sleeve portion 60*c* and the driver portion 62*c* are threadingly-engaged with respect to one another.

The exemplary driver portion 62*c* includes a base portion 86*c* being a threaded shank and including a slot 88*c* extending along the longitudinal axis 24*c*. The exemplary driver portion 62*c* can also include a ring 90*c*. The ring 90*c* can be threadingly engaged with the base portion 86*c*. The ring 90*c* can allow the base portion 86*c* to be adjustably positioned relative to the tubular sleeve portion 60*c*. For example, during initial positioning, the extent that the base portion 86*c* extends through a threaded aperture 92*c* of the tubular sleeve portion 60*c* can be limited by the position of the ring 90*c* along the base portion 86*c*. The ring 90*c* can be sized to prevent passage through the aperture 92*c*. The ring 90*c* can also include a slot 94*c*, visible in FIG. 4.

The exemplary driver portion 62*c* can also include a key 96*c*. The key 96*c* can be mounted in the slot 88*c* for sliding movement. The key 96*c* can be selectively received in the slot 94*c*. When the key 96*c* is received in the slot 94, the ring 90*c* and the base portion 86*c* are locked together for concurrent rotation in the same direction.

The exemplary driver portion 62*c* can also include a nut 98*c*. The nut 98*c* can have aperture 100*c* defining splines. The ring 90*c* can have an outer surface 102*c* defining splines. The splines of the nut 98*c* and the splines of the outer surface 102*c* can engage one another to lock the nut 98*c* and the ring 90*c* together for concurrent rotation in the same direction.

Figure 4:
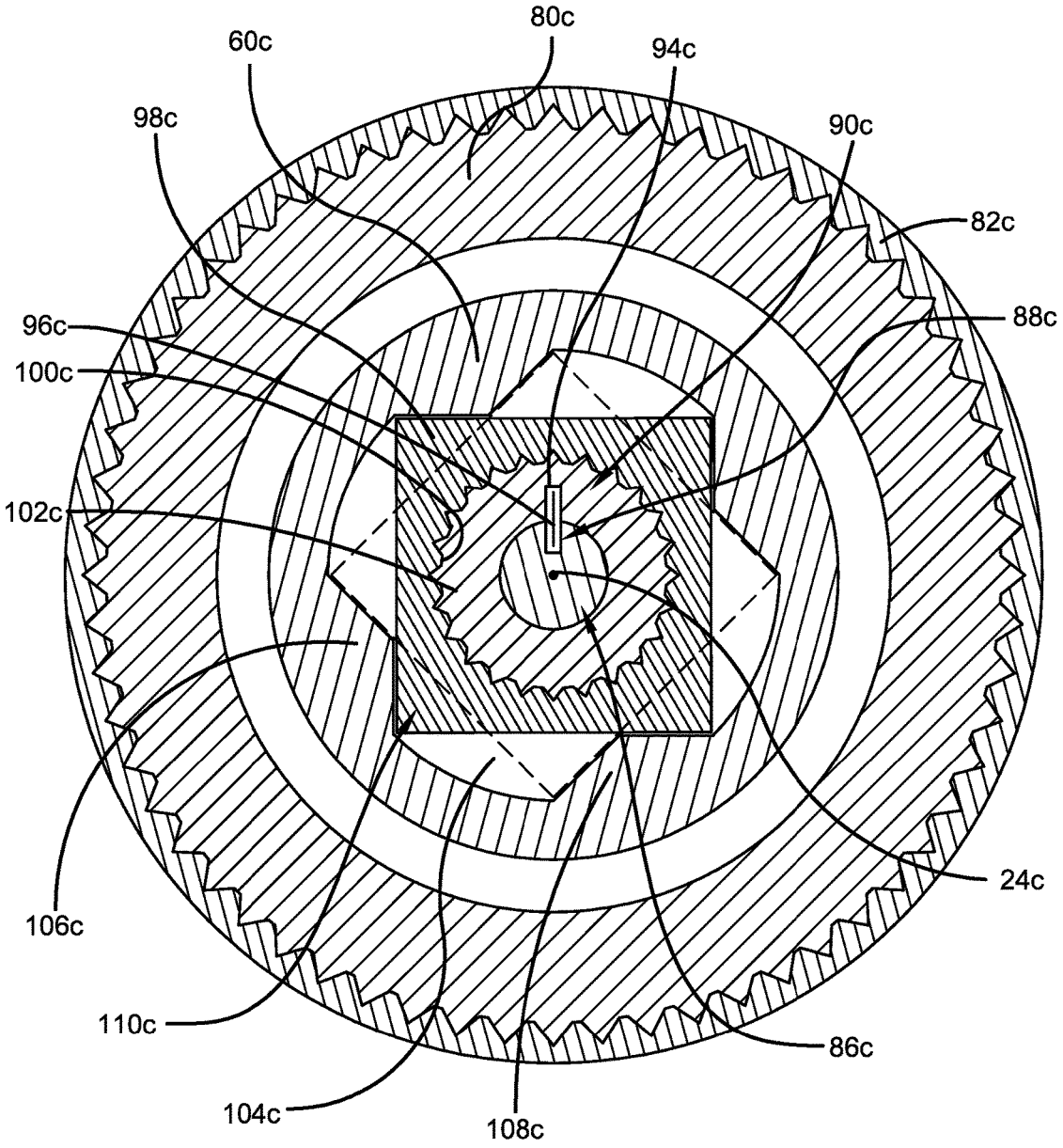
FIG. 4 is a cross-section taken through section lines 4-4 in FIG. 3.

FIG. 4 is a cross-section perpendicular to the longitudinal axis 24*c*. FIGS. 3 and 4 show at least some length of overlap of the tubular sleeve portion 60*c* and the driver portion 62*c* along the longitudinal axis 24*c*. FIG. 4 shows a radial gap 104*c* is defined between the tubular sleeve portion 60*c* and the driver portion 62*c* (represented by the nut 98*c*). The exemplary radial gap 104*c* extends an angular distance about the longitudinal axis 24 less than three hundred and sixty degrees. The tubular sleeve portion 60*c* defines a first shoulder 106*c* and a second shoulder 108*c* each extending radially with respect to the longitudinal axis 24*c* and spaced from one another about the longitudinal axis 24*c*. The first shoulder 106*c* and a second shoulder 108*c* thereby define the angular distance of the radial gap 104*c*; the angular distance between the shoulders 106*c*, 108*c* is the distance of the radial gap 104*c*. The nut 98*c* of the driver portion 62*c* defines a protuberance 110*c* (in the form of a corner) extending radially in the radial gap 104*c* between the first shoulder 106*c* and the second shoulder 108*c*.

In an exemplary method of using the third embodiment, the exemplary outer socket 44*c* can be telescopically retracted by drawing the first socket portion 80*c* against the spring 84*c* and into the second socket portion 82*c*. The exemplary tubular sleeve member 52*c* can then be screwed onto the shank 14*c*, the threads of the tubular sleeve portion 60*c* threaded on the threads of the shank 14*c*. The tubular sleeve member 52*c* can be screwed onto the shank 14*c* until the tip or distal end of the base portion 86*c* contacts the distal end of the shank 14*c*. The key 96*c* can then be inserted in the slot 94*c* and the nut 98*c* can be positioned to surround the ring 90*c* so that the splines of the nut 98*c* and the ring 90*c* are meshed. The first socket portion 80*c* can then be released so that the output socket 44*c* telescopically expands and the female polygonal opening 50*c* mates with a nut 12*c* on the shank 14*c*. Rotation in a first rotational direction can then be input to an input member, resulting in the breaking of the engagement between the threads of the nut 12*c* and the threads of the shank 14*c*. During this rotation in the first rotational direction, the protuberance 110*c* can press against the shoulder 106*c*.

After the engagement between the threads of the nut 12*c* and the threads of the shank 14*c* is broken, the first socket portion 80*c* can be drawn back into the second socket portion to disengage the female polygonal opening 50*c* from the nut 12*c*. Rotation in a second rotational direction opposite to the first rotational direction can then be input to an input member, initially resulting in the protuberance 110*c* traversing the radial gap 104*c* to contact and press against the shoulder 108*c*. During this initial movement, the compressive force applied to the distal end of the shank 14*c* by the base portion 86*c* is eliminated or diminished, dropping the torque required to unscrew the tubular sleeve portion 60*c* from the shank 14*c*. Further rotation in the second rotational direction unscrews the tubular sleeve portion 60*c* from the shank 14*c*.

Figure 5:
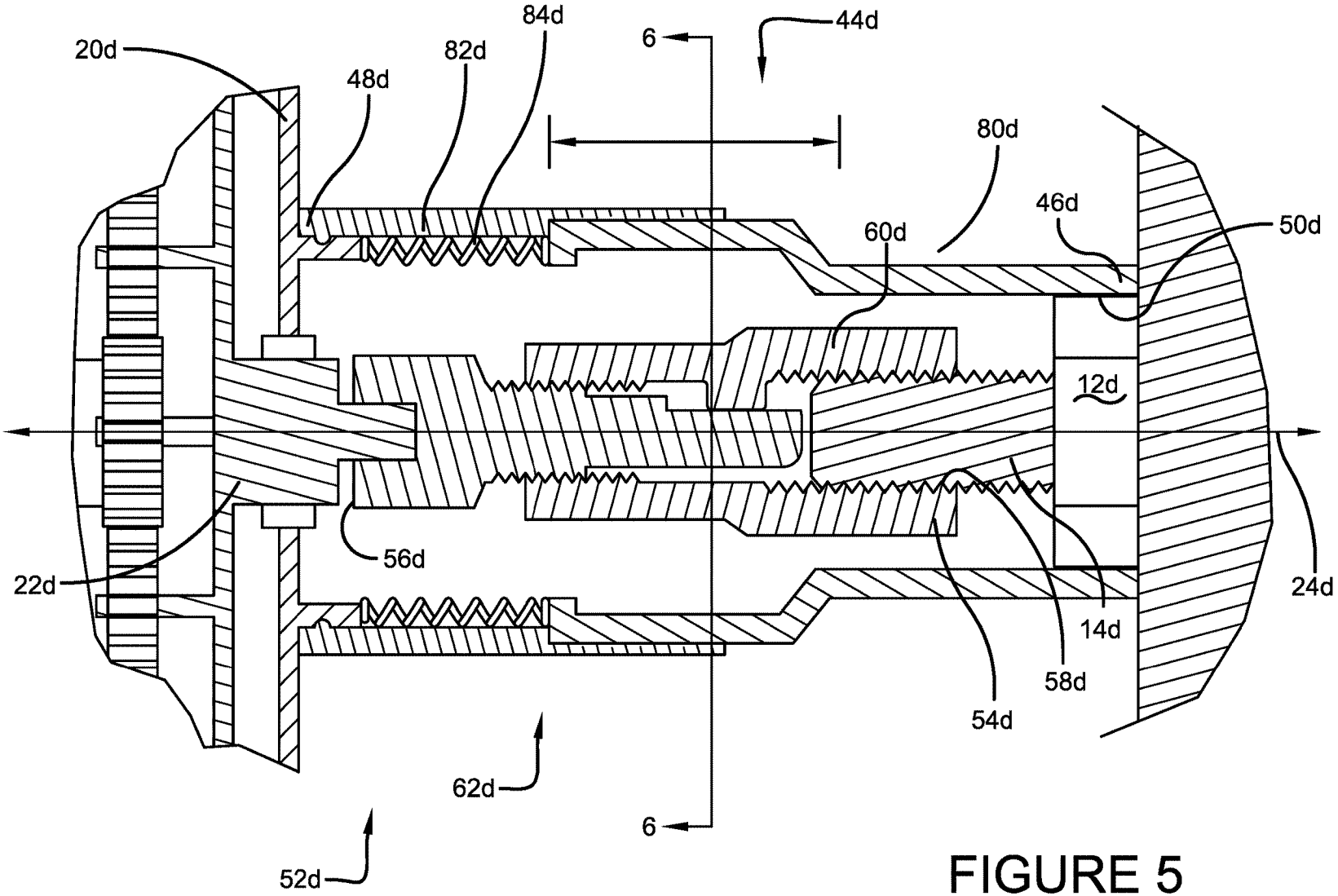
FIG. 5 is a cross-section of a tubular sleeve member and an outer socket of a fastener removal apparatus according to another exemplary embodiment of the present disclosure.

FIG. 5 is a cross-section of a tubular sleeve member 52*d* and an outer socket 44*d* of a fastener removal apparatus according to another exemplary embodiment of the present disclosure. The outer socket 44*d* can include a first socket portion 80*d* and a second socket portion 82*d*. The first socket portion 80*d* can include the first end 46*d* of the outer socket 44*d* and the female polygonal opening 50*d*. The second socket portion 82*d* can include the second end 48*d* of the outer socket 44*d* and can be engaged for concurrent rotation with a first output member 20*d*. The first socket portion 80*d* and the second socket portion 82*d* can be telescopically engaged with one another. A spring 84*d* can bias the first socket portion 80*d* away from the second socket portion 82*d* and away from the first output member 20*d* to maximize the length of the outer socket 44*d* along the longitudinal axis 24*d*. The outer socket 44*d* can be telescopically retracted by urging the first socket portion 80*d* into the second socket portion 82*d*, against the biasing force exerted by the spring 84*d*. One or more embodiments of the present disclosure can include one or more clips to retain the outer socket 44*d* in the telescopically retracted condition.

The tubular sleeve member 52*d* extends along and is centered on a longitudinal axis 24*d* between a first end 54*d* defining a threaded opening 58*d* for receiving threads defined by a threaded shank 14*d* and a second end 56*d* spaced from the first end 54*d* along the longitudinal axis 24*d* and engageable for concurrent rotation with a second output member 22*d*.

The exemplary tubular sleeve member 52*d* includes tubular sleeve portion 60*d* and a driver portion 62*d*. The tubular sleeve portion 60*d* can include the first end 54*d* and the threaded opening 58*d*. The driver portion 62*d* can include the second end 56*d*. In the third exemplary embodiment of the present disclosure, the tubular sleeve portion 60*d* and the driver portion 62*d* are threadingly-engaged with respect to one another.

Figure 6:
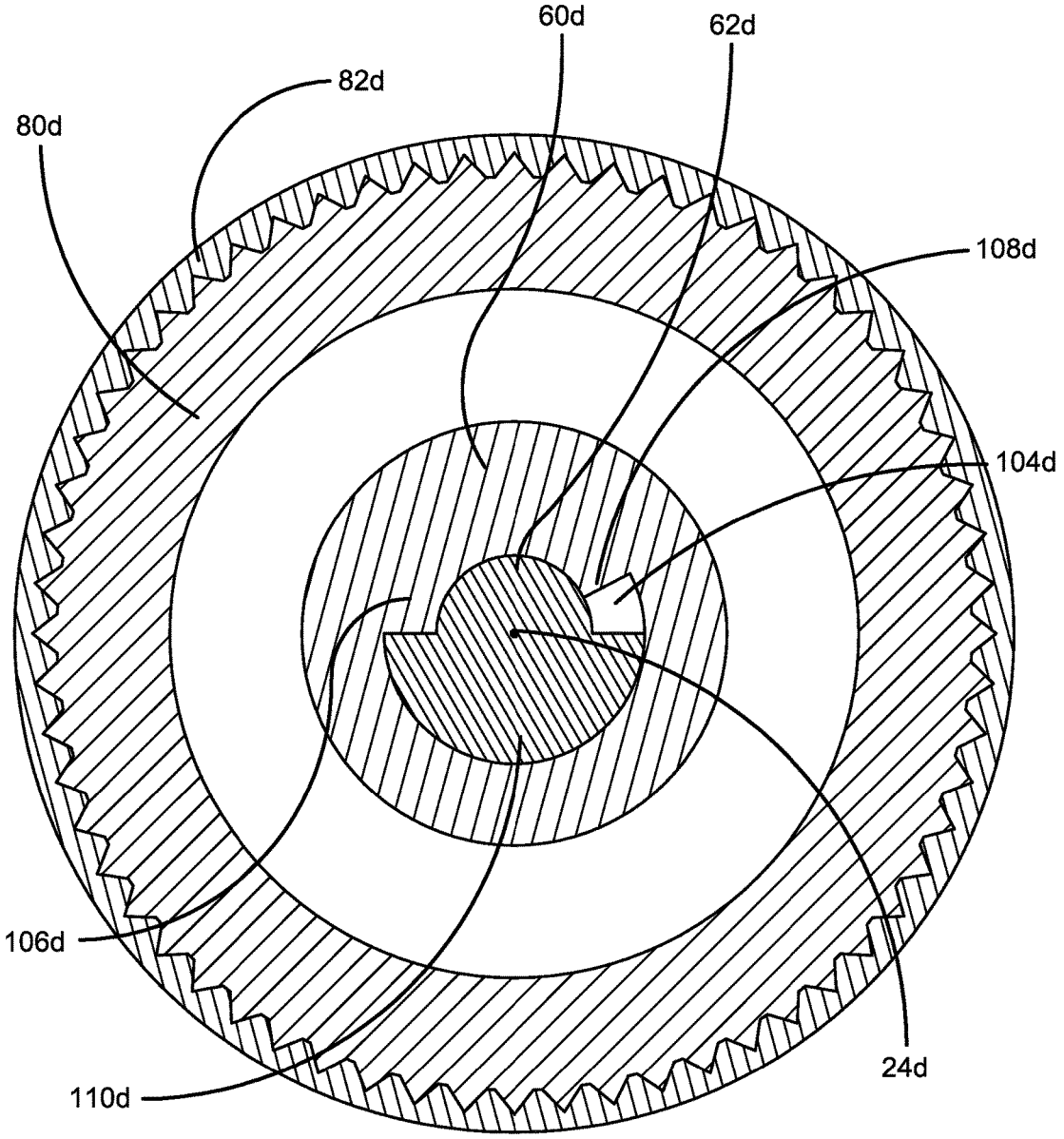
FIG. 6 is a cross-section taken through section lines 6-6 in FIG. 5.

FIG. 6 is a cross-section perpendicular to the longitudinal axis 24*d*. FIGS. 5 and 6 show at least some length of overlap of the tubular sleeve portion 60*d* and the driver portion 62*d* along the longitudinal axis 24*d*. FIG. 6 shows a radial gap 104*d* is defined between the tubular sleeve portion 60*d* and the driver portion 62*d*. The exemplary radial gap 104*d* extends an angular distance about the longitudinal axis 24*d* less than three hundred and sixty degrees. The tubular sleeve portion 60*d* defines a first shoulder 106*d* and a second shoulder 108*d* each extending radially with respect to the longitudinal axis 24*d* and spaced from one another about the longitudinal axis 24*d*. The first shoulder 106*d* and a second shoulder 108*d* thereby define the angular distance of the radial gap 104*d*; the angular distance between the shoulders 106*d*, 108*d* is the distance of the radial gap 104*d*. The driver portion 62*d* defines a protuberance 110*d* extending radially in the radial gap 104*d* between the first shoulder 106*d* and the second shoulder 108*d*.

In an exemplary method of using the fourth embodiment, the exemplary outer socket 44*d* can be telescopically retracted by drawing the first socket portion 80*d* against the spring 84*d* and into the second socket portion 82*d*. The exemplary tubular sleeve member 52*d* can then be screwed onto the shank 14*d*, the threads of the tubular sleeve portion 60*d* threaded on the threads of the shank 14*d*. The tubular sleeve member 52*d* can be screwed onto the shank 14*d* until the tip or distal end of the driver portion 62*d* contacts the distal end of the shank 14*d*. The first socket portion 80*d* can then be released so that the output socket 44*d* telescopically expands and the female polygonal opening 50*d* mates with a nut 12*d* on the shank 14*d*. Rotation in a first rotational direction can then be input to an input member, resulting in the breaking of the engagement between the threads of the nut 12*d* and the threads of the shank 14*d*. During this rotation in the first rotational direction, the protuberance 110*d* can press against the shoulder 106*d*.

After the engagement between the threads of the nut 12*d* and the threads of the shank 14*d* is broken, the first socket portion 80*d* can be drawn back into the second socket portion to disengage the female polygonal opening 50*d* from the nut 12*d*. Rotation in a second rotational direction opposite to the first rotational direction can then be input to an input member, initially resulting in the protuberance 110*d* traversing the radial gap 104*d* to contact and press against the shoulder 108*d*. During this initial movement, the compressive force applied to the distal end of the shank 14*d* by the base portion 86*d* is eliminated or diminished, dropping the torque required to unscrew the tubular sleeve portion 60*d* from the shank 14*d*. Further rotation in the second rotational direction unscrews the tubular sleeve portion 60*d* from the shank 14*d*.

Figure 7:
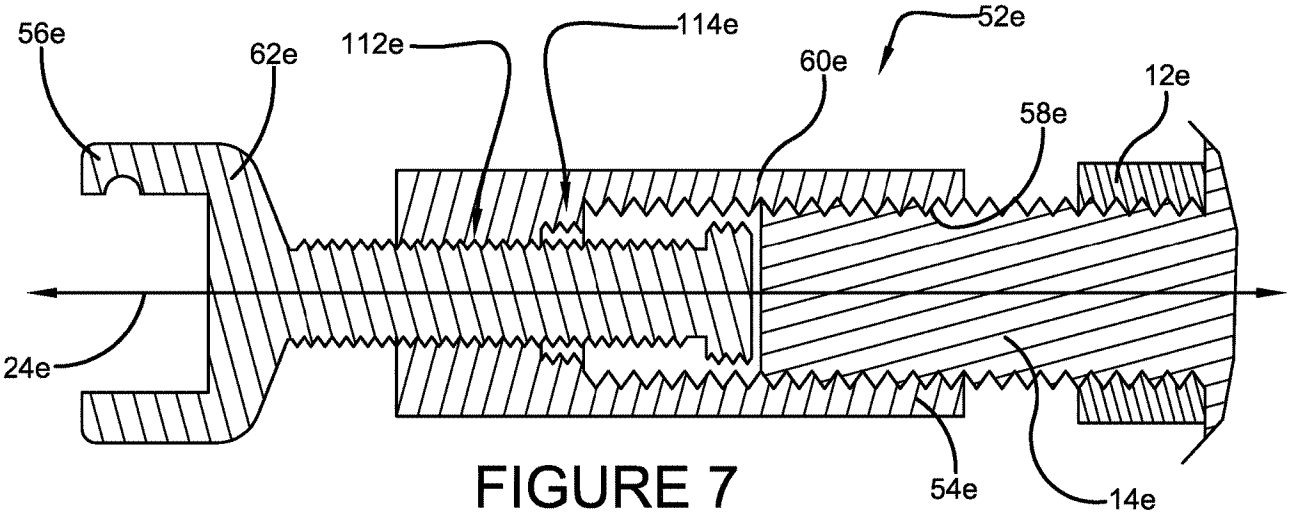
FIG. 7 is a cross-section of a tubular sleeve member of a fastener removal apparatus according to another exemplary embodiment of the present disclosure.

FIG. 7 is a cross-section of a tubular sleeve member 52*e* of a fastener removal apparatus according to another exemplary embodiment of the present disclosure. The tubular sleeve member 52*e* extends along and is centered on a longitudinal axis 24*e* between a first end 54*e* defining a threaded opening 58*e* for receiving threads defined by a threaded shank 14*e* and a second end 56*e* spaced from the first end 54*e* along the longitudinal axis 24*e* and engageable for concurrent rotation with a second output member.

The exemplary tubular sleeve member 52*e* includes tubular sleeve portion 60*e* and a driver portion 62*e*. The tubular sleeve portion 60*e* can include the first end 54*e* and the threaded opening 58*e*. The driver portion 62*e* can include the second end 56*e*. In the third exemplary embodiment of the present disclosure, the tubular sleeve portion 60*e* and the driver portion 62*e* are threadingly-engaged with respect to one another.

The exemplary tubular sleeve portion 60*e* and driver portion 62*e* are threadingly-engaged through a first pair of mating threads (referenced at 112*e*) and a second pair (referenced at 114*e*) of mating threads. The exemplary first pair 112*e* of mating threads and the second pair 114*e* of mating threads have different diameters. In this exemplary embodiment of the present disclosure, in response to rotation of the driver portion 62*e* in a first rotational direction over a first angular range, the driver portion 62*e* and the tubular sleeve portion 60*e* are threadingly-engaged only through the first pair 112*e* of mating threads and the tubular sleeve portion 60*e* is not driven in the first rotational direction. In this example, the first rotational direction can be defined when a compressive load applied by the driver portion 62*e* on the shank 14*e* is being reduced, after the engagement between the threads of the nut 12*e* and the threads of the shank 14*e* has been broken.

In addition, the exemplary tubular sleeve portion 60*e* and driver portion 62*e* are threadingly-engaged such that in response to rotation of the driver portion 62*e* in the first rotational direction beyond the first angular range, the driver portion 62*e* and the tubular sleeve portion 60*e* are threadingly-engaged through both of the first pair 112*e* of mating threads the second pair 114*e* of mating threads and the tubular sleeve portion 60*e* is driven in the first rotational direction. Thus, in this embodiment, lost motion over more than three hundred and sixty degrees occurs between the tubular sleeve portion 60*e* and driver portion 62*e* during removal of the tubular sleeve portion 60*e* from the shank 14*e*.

Figure 8:
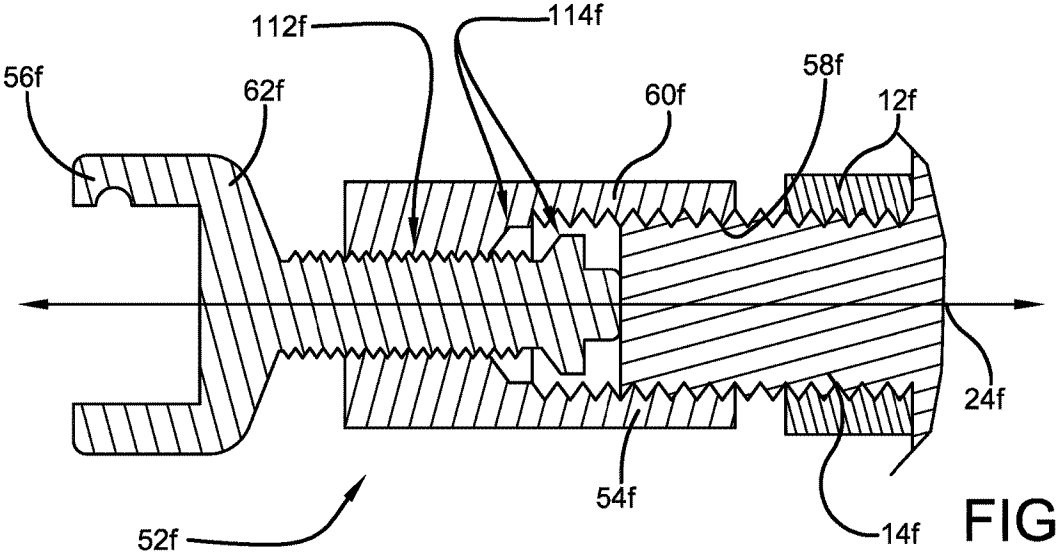
FIG. 8 is a cross-section of a tubular sleeve member of a fastener removal apparatus according to another exemplary embodiment of the present disclosure.

FIG. 8 is a cross-section of a tubular sleeve member 52*f* of a fastener removal apparatus according to another exemplary embodiment of the present disclosure. The tubular sleeve member 52*f* extends along and is centered on a longitudinal axis 24*f* between a first end 54*f* defining a threaded opening 58*f* for receiving threads defined by a threaded shank 14*f* and a second end 56*f* spaced from the first end 54*f* along the longitudinal axis 24*f* and engageable for concurrent rotation with a second output member.

The exemplary tubular sleeve member 52*f* includes tubular sleeve portion 60*f* and a driver portion 62*f*. The tubular sleeve portion 60*f* can include the first end 54*f* and the threaded opening 58*f*. The driver portion 62*f* can include the second end 56*f*. In the third exemplary embodiment of the present disclosure, the tubular sleeve portion 60*f* and the driver portion 62*f* are threadingly-engaged with respect to one another.

The exemplary tubular sleeve portion 60*f* and driver portion 62*f* are threadingly-engaged through a first pair of mating threads, referenced at 112*f*, and by a mushroom head or flat surface arrangement, referenced at 114*f*. In this exemplary embodiment of the present disclosure, in response to rotation of the driver portion 62*f* in a first rotational direction over a first angular range, the driver portion 62*f* and the tubular sleeve portion 60*f* are threadingly-engaged only through the first pair 112*f* of mating threads and the tubular sleeve portion 60*f* is not driven in the first rotational direction. In this example, the first rotational direction can be defined when a compressive load applied by the driver portion 62*f* on the shank 14*f* is being reduced, after the engagement between the threads of the nut 12*f* and the threads of the shank 14*f* has been broken.

In addition, the exemplary tubular sleeve portion 60*f* and driver portion 62*f* are engaged such that in response to rotation of the driver portion 62*f* in the first rotational direction beyond the first angular range, the driver portion 62*f* and the tubular sleeve portion 60*f* are engaged for concurrent rotation through the Phillips-like arrangement 114*f* and the tubular sleeve portion 60*f* is driven in the first rotational direction. Thus, in this embodiment, lost motion over more than three hundred and sixty degrees occurs between the tubular sleeve portion 60*f* and driver portion 62*f* during removal of the tubular sleeve portion 60*f* from the shank 14*f*.

Figure 9:
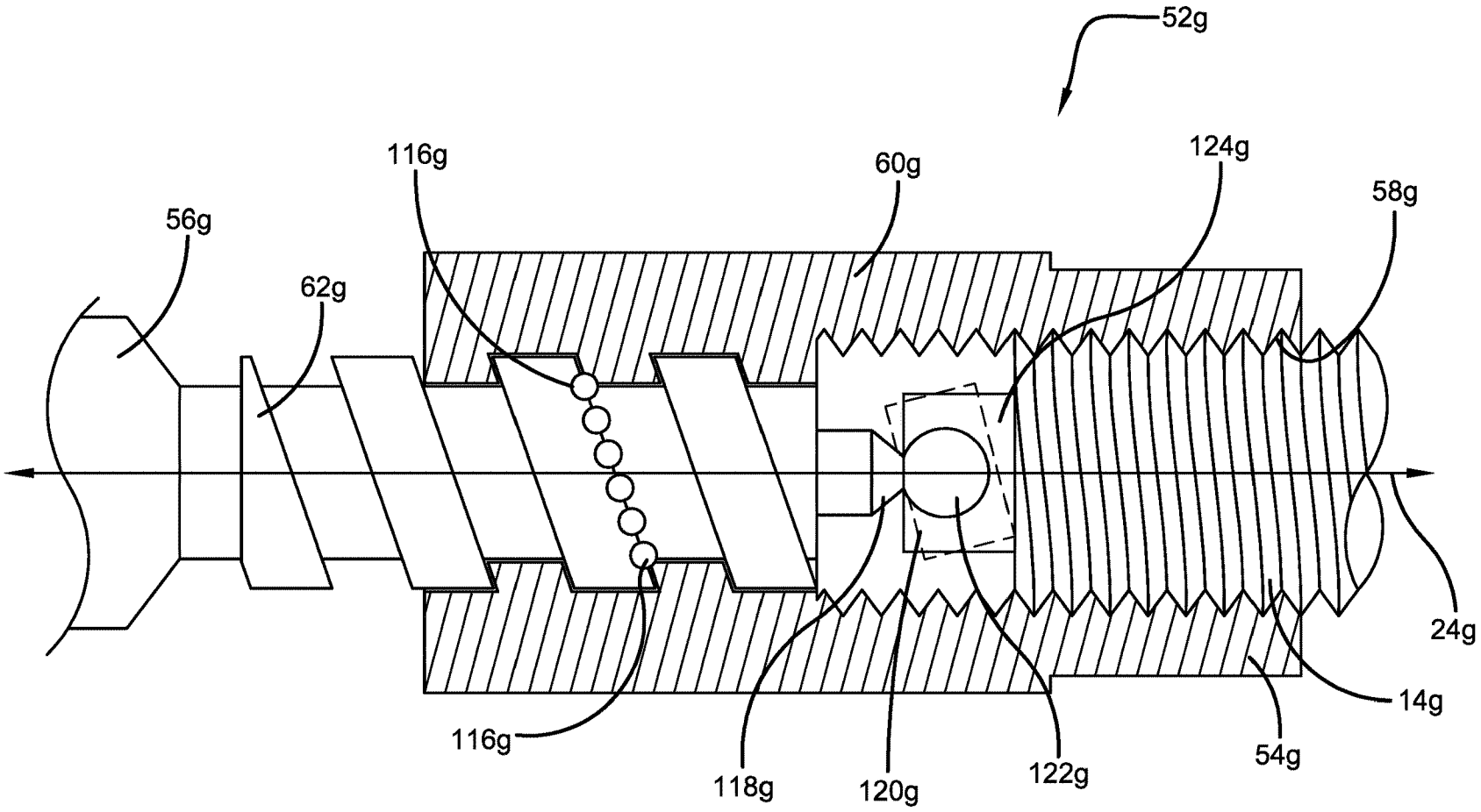
FIG. 9 is a cross-section of a tubular sleeve member of a fastener removal apparatus according to another exemplary embodiment of the present disclosure.

FIG. 9 is a cross-section of a tubular sleeve member 52*g* of a fastener removal apparatus according to another exemplary embodiment of the present disclosure. The tubular sleeve member 52*g* extends along and is centered on a longitudinal axis 24*g* between a first end 54*g* defining a threaded opening 58*g* for receiving threads defined by a threaded shank 14*g* and a second end 56*g* spaced from the first end 54*g* along the longitudinal axis 24*g* and engageable for concurrent rotation with a second output member.

The exemplary tubular sleeve member 52*g* includes tubular sleeve portion 60*g* and a driver portion 62*g*. The tubular sleeve portion 60*g* can include the first end 54*g* and the threaded opening 58*g*. The driver portion 62*g* can include the second end 56*g*. In the third exemplary embodiment of the present disclosure, the tubular sleeve portion 60*g* and the driver portion 62*g* are threadingly-engaged with respect to one another, with thread angles that release when input torque is ceased, relieving tension between threads for easy removal.

The tubular sleeve member 52*g* further comprises a plurality of bearings 116*g*. The plurality of bearings 116*g* can be mounted in one of the tubular sleeve portion 60*g* and the driver portion 62*g*. The plurality of bearings 116*g* can be operably disposed between the tubular sleeve portion 60*g* and the driver portion 62*g*.

The tubular sleeve member 52*g* can also include a mounting post 118*g* and a landing plate 120*g*. The mounting post 118*g* can be disposed at an end of the driver portion 62*g* opposite to the second end 56*g* of the tubular sleeve member 52*g* and can be at least partially spherical. The landing plate 120*g* can be disposed on the mounting post 118*g*. The landing plate 120*g* can define a recess 122*g* receiving at least a portion of the mounting post 118*g* on first side and a substantially flat surface 124*g* on a second side opposite the first side. The landing plate 120*g* can thus be configured to swivel relative to the mounting post 118*g* to accommodate distal ends of shanks 14*e* that do not define a plane that is perpendicular to the longitudinal axis 24*g*.

Figure 10:
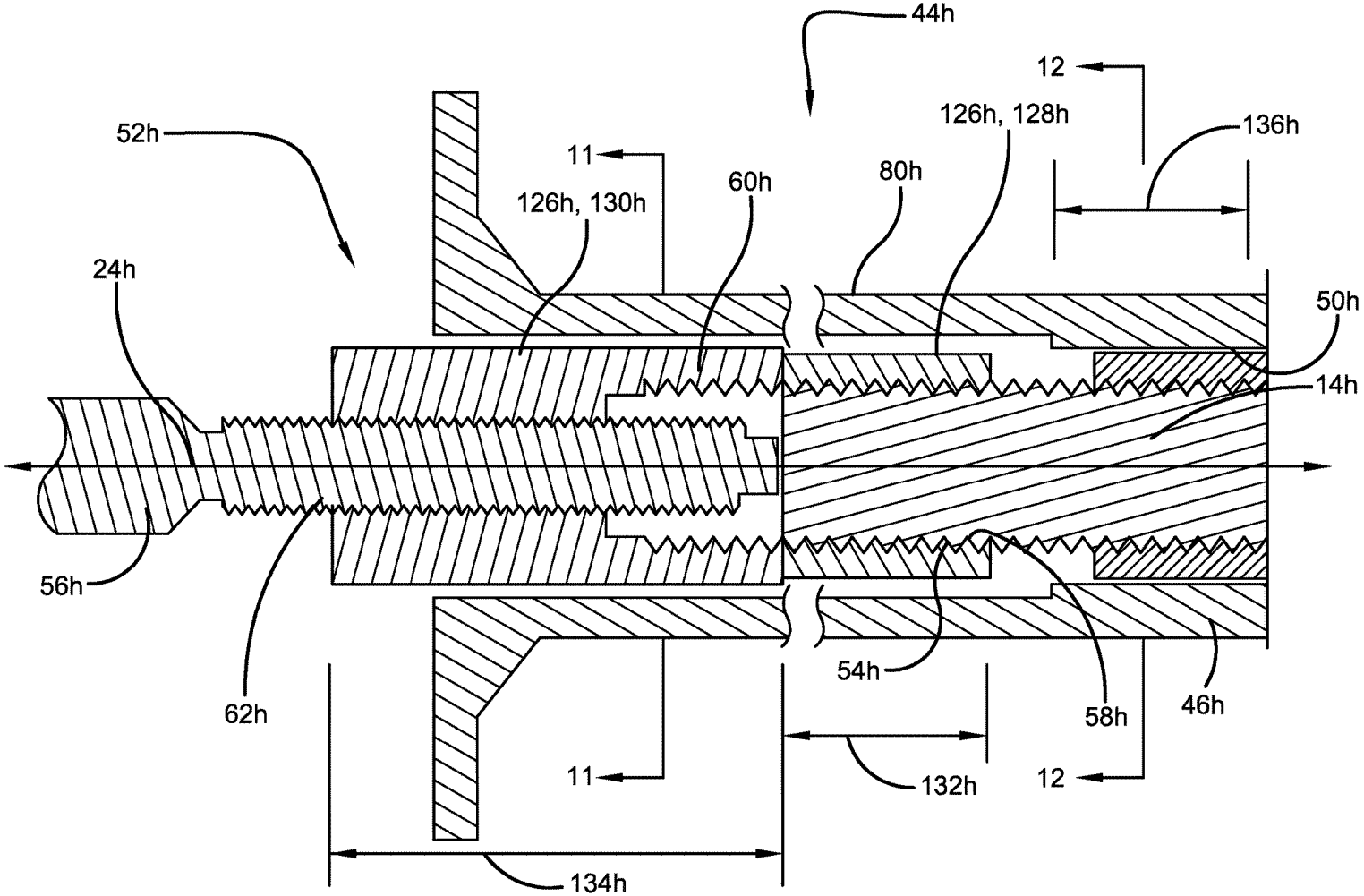
FIG. 10 is a cross-section of a tubular sleeve member and an outer socket of a fastener removal apparatus according to another exemplary embodiment of the present disclosure.

FIG. 10 is a cross-section of a tubular sleeve member 52*h* and an outer socket of a fastener removal apparatus according to another exemplary embodiment of the present disclosure. The outer socket can include a first socket portion 80*h* and a second socket portion. The first socket portion 80*h* can include a first end 46*h* of the outer socket and a female polygonal opening 50*h*. The first socket portion 80*h* and the second socket portion can be telescopically engaged with one another. A spring can bias the first socket portion 80*h* away from the second socket portion and away from a first output member to maximize the length of the outer socket along the longitudinal axis 24*h*. The outer socket can be telescopically retracted by urging the first socket portion 80*h* into the second socket portion, against the biasing force exerted by the spring. One or more embodiments of the present disclosure can include one or more clips to retain the outer socket in the telescopically retracted condition.

The tubular sleeve member 52*h* extends along and is centered on a longitudinal axis 24*h* between a first end 54*h* defining a threaded opening 58*h* for receiving threads defined by a threaded shank 14*h* and a second end 56*h* spaced from the first end 54*h* along the longitudinal axis 24*h* and engageable for concurrent rotation with a second output member.

The exemplary tubular sleeve member 52*h* includes tubular sleeve portion 60*h* and a driver portion 62*h*. The tubular sleeve portion 60*h* can include the first end 54*h* and the threaded opening 58*h*. The driver portion 62*h* can include the second end 56*h*. In the third exemplary embodiment of the present disclosure, the tubular sleeve portion 60*h* and the driver portion 62*h* are threadingly-engaged with respect to one another.

Figure 11:
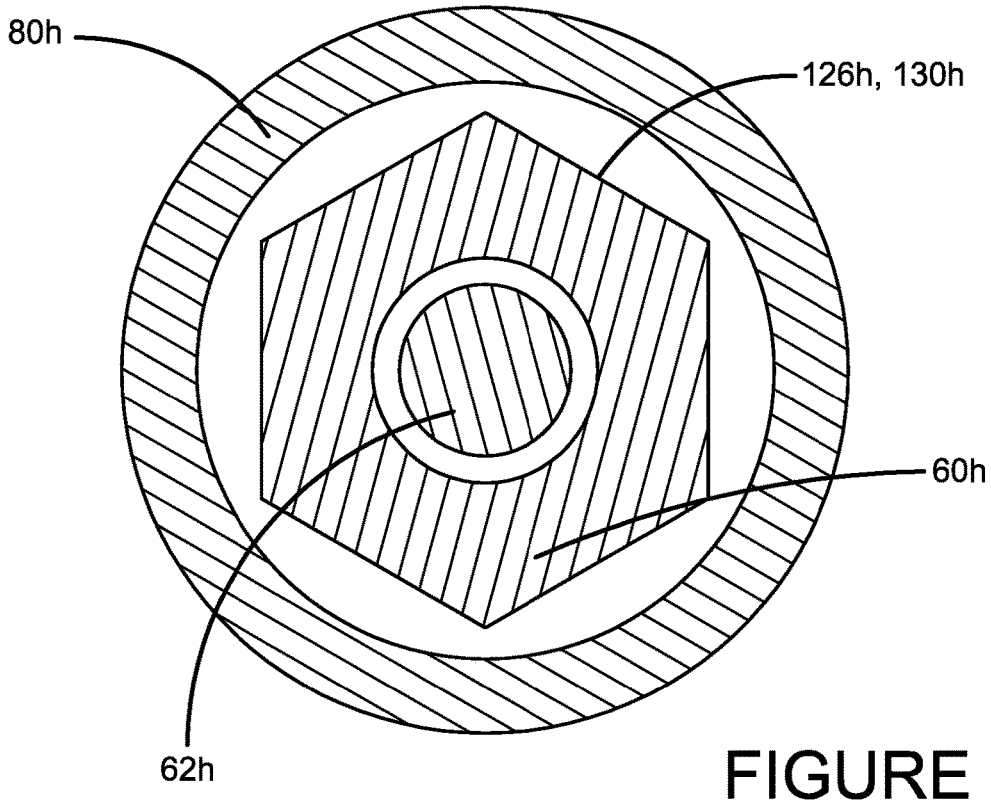
FIG. 11 is a cross-section taken through section lines 11-11 in FIG. 10.
Figure 12:
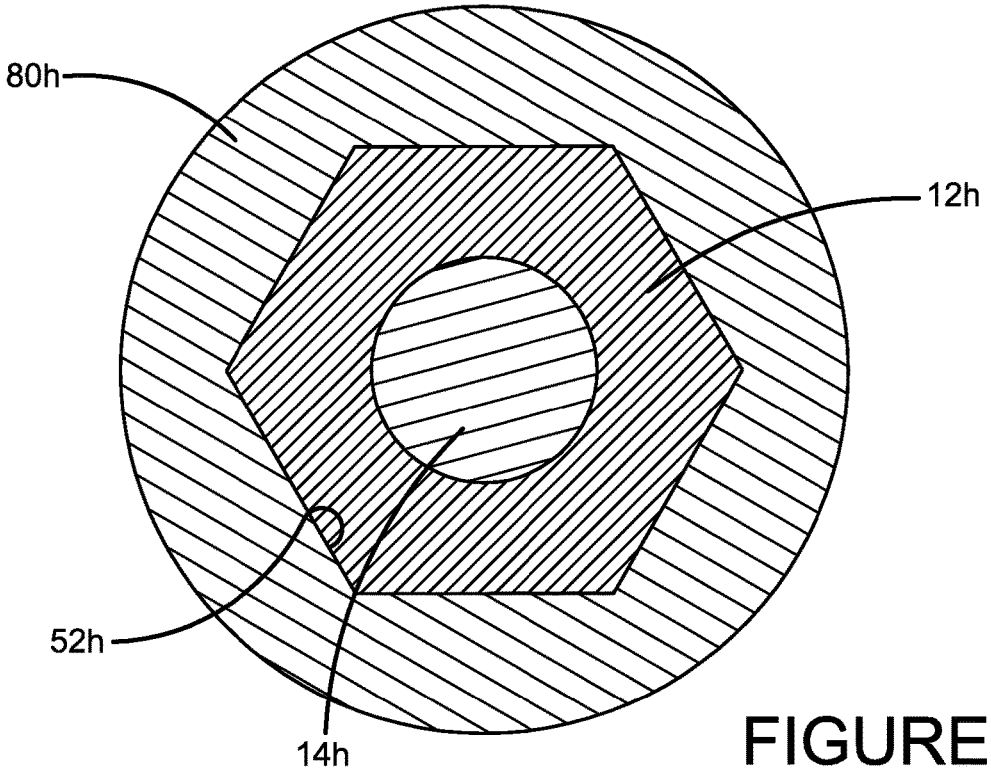
FIG. 12 is a cross-section taken through section lines 12-12 in FIG. 10.

At least part of an outer surface 126*h* of the tubular sleeve portion 60*h* is sized and shaped to mate with the female polygonal opening 50*h*. The outer surface 126*h* of the tubular sleeve portion 60*h* includes a first portion 128*h* extending a first length 132*h* along the longitudinal axis 24*h* and having a circular cross-section with an outer diameter smaller than the female polygonal opening 50*h*. The outer surface 126*h* also includes a second portion 130*h* extending a second length 134*h* along the longitudinal axis 24*h* and defining the part of the outer surface 126*h* of the tubular sleeve portion 60*h* that is sized and shaped to mate with the female polygonal opening 50*h*. The first portion 128*h* is closer to the female polygonal opening 50*h* along the longitudinal axis 24*h* when the first socket portion 80*h* and the second socket portion 82*h* are fully telescopically extended with respect to one another. The female polygonal opening 50*h* extends a third length 136*h* along the longitudinal axis 24*h*. The first length 132*h* equal to or less than the third length 136*h*. FIGS. 11 and 12 are cross-sections perpendicular to the longitudinal axis 24*h* and show that the female polygonal opening 50*h* is sized and shaped to mate with the second portion 130*h* of the outer surface 126*h*.

In an exemplary method of using the fourth embodiment, the exemplary outer socket 44*h* can be telescopically retracted by drawing the first socket portion 80*h* against the spring and into the second socket portion. The exemplary tubular sleeve member 52*h* can then be screwed onto the shank 14*h*, the threads of the tubular sleeve portion 60*h* threaded on the threads of the shank 14*h*. The tubular sleeve member 52*h* can be screwed onto the shank 14*h* until the tip or distal end of the driver portion 62*h* contacts the distal end of the shank 14*h*. The first socket portion 80*h* can then be released so that the output socket 44*h* telescopically expands and the female polygonal opening 50*h* mates with a nut 12*h* on the shank 14*h*. Rotation in a first rotational direction can then be input to an input member, resulting in the breaking of the engagement between the threads of the nut 12*h* and the threads of the shank 14*h*.

After the engagement between the threads of the nut 12*h* and the threads of the shank 14*h* is broken, the first socket portion 80*h* can be drawn back into the second socket portion to disengage the female polygonal opening 50*h* from the nut 12*h* and also to mate the female polygonal opening 50*h* with the second portion 130*h*. Rotation in a second rotational direction opposite to the first rotational direction can then be input to an input member, initially resulting in the first socket portion 80*h* unscrewing the tubular sleeve portion 60*h* from the shank 14*h*.

It is noted that in one or more embodiments of the present disclosure, the gearbox assembly can be configured to allow the first and second output members to turn in the same direction. This could be accomplished by sliding over of gears. Such an embodiment would be useful for tightening nuts. Such an embodiment could operate such that the input (wrench/drill side) could impart counterclockwise rotation to the input member and the gearbox assembly could output clockwise rotation through both of the first and second output members.

While the present disclosure has been described with reference to an exemplary embodiment, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the appended claims. The right to claim elements and/or subcombinations that are disclosed herein as other present disclosures in other patent documents is hereby unconditionally reserved.

What is claimed is:

1. A fastener removal apparatus configured for removing a nut from a threaded shank and comprising:

a gearbox assembly having an input member, a first output member, a second output member, and a plurality of gears disposed between said input member and said first output member such that said first output member and said second output member rotation in opposite directions about a longitudinal axis in response to rotation imparted to said input member;

an outer socket extending along and centered on said longitudinal axis between a first end defining a female polygonal opening for mating with the fastening nut and a second end spaced from the first end along said longitudinal axis and engaged for concurrent rotation with said first output member; and a tubular sleeve member surrounded by said outer socket, said tubular sleeve member extending along and centered on said longitudinal axis between a first end defining a threaded opening for receiving threads defined by the threaded shank and a second end spaced from the first end along said longitudinal axis and engaged for concurrent rotation with said second output member.

2. The fastener removal apparatus of claim 1 wherein said tubular sleeve member further comprises:

a tubular sleeve portion including said first end of said tubular sleeve member and said threaded opening; and a driver portion including said second end of said tubular sleeve member and engaged for concurrent rotation with said second output member.

3. The fastener removal apparatus of claim 2 wherein said tubular sleeve portion and said driver portion are integrally-formed with respect to one another.

4. The fastener removal apparatus of claim 2 wherein said tubular sleeve portion and said driver portion are threadingly-engaged with respect to one another.

5. The fastener removal apparatus of claim 4 wherein said tubular sleeve portion and said driver portion are threadingly-engaged with respect to one another such that:

in response to rotation of said driver portion in a first rotational direction over at least some angular range, said tubular sleeve portion is driven in said first rotational direction; and in response to rotation of said driver portion in a second rotational direction opposite to said first rotational direction over said at least some angular range, said tubular sleeve portion is not driven in said second rotational direction.

6. The fastener removal apparatus of claim 5 wherein said at least some angular range is further defined as a one-quarter or less turn of said driver portion.

7. The fastener removal apparatus of claim 5 further comprising:

a pin extending perpendicular to said longitudinal axis and passing through at least part of said tubular sleeve portion and said driver portion, wherein one of said tubular sleeve portion and said driver portion receives said pin in a slot that extends around said longitudinal axis.

8. The fastener removal apparatus of claim 5 wherein, in a cross-section perpendicular to said longitudinal axis, for at least some length of overlap of said tubular sleeve portion and said driver portion along said longitudinal axis, a radial gap is defined between said tubular sleeve portion and said driver portion, said radial gap extending an angular distance about said longitudinal axis less than three hundred and sixty degrees, one of said tubular sleeve portion and said driver portion defines a first shoulder and a second shoulder each extending radially with respect to said longitudinal axis and spaced from one another about said longitudinal axis and thereby defining said angular distance of said radial gap, and the other of said tubular sleeve portion and said driver portion defines a protuberance extending radially in said radial gap between said first shoulder and said second shoulder.

9. The fastener removal apparatus of claim 8 wherein said other of said tubular sleeve portion and said driver portion that defines said protuberance further comprises:

a base portion radially inward of said protuberance and having a first slot;

a second slot fixedly associated with said protuberance; and a key selectively insertable in both of said first slot and said second slot concurrently to selectively lock said base portion and said protuberance.

10. The fastener removal apparatus of claim 9 wherein said protuberance is further defined as a corner.

11. The fastener removal apparatus of claim 9 wherein said second slot is defined by a ring encircling said base portion, wherein said protuberance is defined by a nut, and wherein said nut and said ring are selectively engageable with one another through splines.

12. The fastener removal apparatus of claim 4 wherein said tubular sleeve portion and said driver portion are threadingly-engaged through a first pair of mating threads and a second pair of mating threads such that:

in response to rotation of said driver portion in a first rotational direction over a first angular range, said driver portion and said tubular sleeve portion are threadingly-engaged only through said first pair of mating threads and said tubular sleeve portion is not driven in said first rotational direction; and in response to rotation of said driver portion in said first rotational direction beyond said first angular range, said driver portion and said tubular sleeve portion are threadingly-engaged through both of said first pair of mating threads said second pair of mating threads and said tubular sleeve portion is driven in said first rotational direction.

13. The fastener removal apparatus of claim 12 wherein said first pair of mating threads and said second pair of mating threads have different diameters.

14. The fastener removal apparatus of claim 4 wherein said tubular sleeve member further comprises:

a plurality of bearings mounted in one of said tubular sleeve portion and said driver portion and operably disposed between said tubular sleeve portion and said driver portion.

15. The fastener removal apparatus of claim 2 further comprising:

a mounting post disposed at an end of said driver portion opposite to said second end of said tubular sleeve member and being at least partially spherical;

a landing plate disposed on said mounting post, said landing plate defining a recess receiving at least a portion of said mounting post on first side and a substantially flat surface on a second side opposite said first side, said landing plate configured to swivel relative to said mounting post.

16. The fastener removal apparatus of claim 2 wherein said tubular sleeve member further comprises:

a blind aperture defined by said tubular sleeve portion in cooperation with said driver portion, said blind aperture centered on said longitudinal axis and open toward said first end and having a floor; and a protuberance projecting along said longitudinal axis away from said floor toward said threaded opening, said protuberance having tip spaced from said floor and said tip having a diameter smaller than a diameter of said blind aperture.

17. The fastener removal apparatus of claim 16 wherein said threaded opening and said tip are proximate to one another such that said tip contacts a distal end of the threaded shank while said threaded opening receives the threads defined by the threaded shank during at least part of the rotation of said tubular sleeve member by said second output member in a first rotational direction and while said outer socket is rotated by said first output member in a second rotational direction opposite to said first rotational direction.

18. The fastener removal apparatus of claim 1 wherein said outer socket further comprises:

a first socket portion including said first end of said outer socket and said female polygonal opening; and a second socket portion including said second end of said outer socket and engaged for concurrent rotation with said first output member, wherein said first socket portion and said second socket portion are telescopically engaged with one another.

19. The fastener removal apparatus of claim 18 wherein said tubular sleeve member further comprises:

a tubular sleeve portion including said first end of said tubular sleeve member and said threaded opening; and a driver portion including said second end of said tubular sleeve member and engaged for concurrent rotation with said second output member, wherein at least part of an outer surface of said tubular sleeve portion is sized and shaped to mate with said female polygonal opening.

20. The fastener removal apparatus of claim 19 wherein said outer surface of said tubular sleeve portion includes:

a first portion extending a first length along said longitudinal axis and having a circular cross-section with an outer diameter smaller than said female polygonal opening; and a second portion extending a second length along said longitudinal axis and defining said part of said outer surface of said tubular sleeve portion that is sized and shaped to mate with said female polygonal opening.

21. The fastener removal apparatus of claim 20 wherein said first portion is closer to said female polygonal opening along said longitudinal axis when said first socket portion and said second socket portion are fully telescopically extended with respect to one another.

22. The fastener removal apparatus of claim 20 wherein said female polygonal opening extends a third length along said longitudinal axis and wherein said first length is not greater than said third length.

* * * * *